United States Patent [19]

Parrott et al.

[11] 4,123,110

[45] Oct. 31, 1978

[54] AUXILIARY DEVICE FOR A MINING MACHINE

[75] Inventors: George A. Parrott, Wakefield; John B. Norris, Leeds, both of Great Britain

[73] Assignee: Dresser Europe S.A., Brussels, Belgium

[21] Appl. No.: 807,305

[22] Filed: Jun. 16, 1977

[30] Foreign Application Priority Data

Jun. 16, 1976 [GB] United Kingdom ..... 24980/76

[51] Int. Cl.[2] ..... E21C 35/20

[52] U.S. Cl. ..... 299/43; 299/18; 299/87

[58] Field of Search ..... 299/18, 31–34, 299/43–48, 87

[56] References Cited

U.S. PATENT DOCUMENTS

| | | | |
|---|---|---|---|
| 3,907,367 | 9/1975 | Nakajima | 299/53 |
| 3,945,680 | 3/1976 | Henrich et al. | 299/43 |

*Primary Examiner*—Ernest R. Purser
*Assistant Examiner*—Nick A. Nichols, Jr.
*Attorney, Agent, or Firm*—Larson, Taylor and Hinds

[57] ABSTRACT

An auxiliary device for a longwall mining machine incorporating an underframe, by which it is mounted for movement along the conveyor of the mining machine, and it is coupled to the mining machine. The auxiliary device comprises a rotary breaking or crushing element drivably carried by the underframe and the underframe is provided with a reaction means, preferably a plate, spaced away from an adjacent periphery of the rotary element. In use, material on the moving conveyor passes between the rotating breaking or crushing element and the reaction plate where the material is broken up or crushed. In this way, it can be ensured that any large lumps of coal or rock on the conveyor can be broken down to a sufficiently small size so as not to become jammed beneath the main frame of the mining machine straddling the conveyor.

10 Claims, 6 Drawing Figures

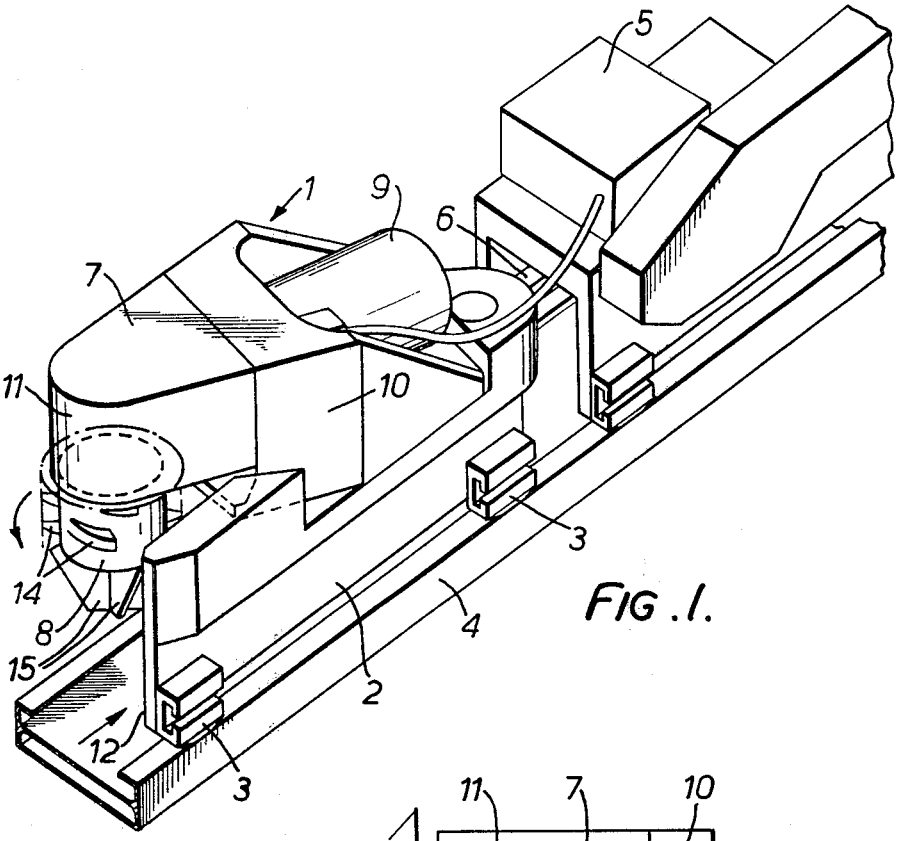
FIG. 1.
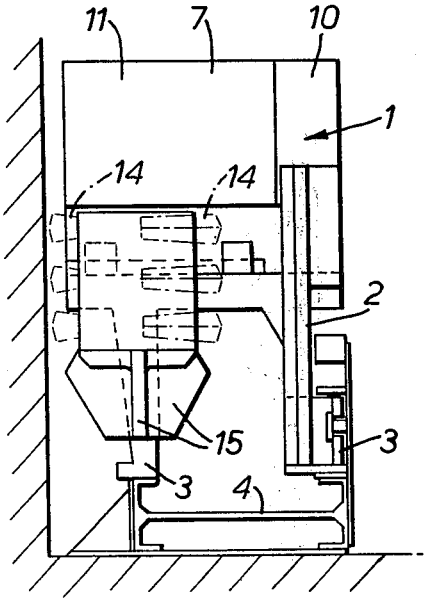
FIG. 4.
FIG. 6.
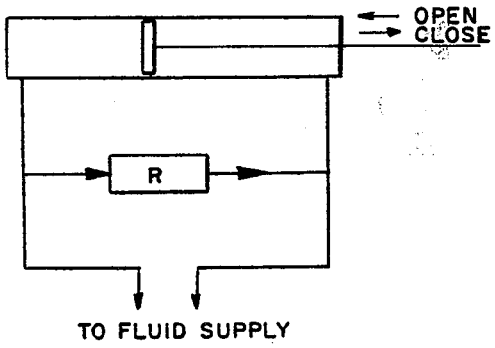

AUXILIARY DEVICE FOR A MINING MACHINE

This invention relates to an auxiliary device adapted to be connected to a conveyor mounted, longwall mining machine.

According to the invention, there is provided an auxiliary device adapted to be connected to a conveyor mounted, longwall mining machine, the auxiliary device comprising an underframe adapted for mounting on and travel along the conveyor of the mining machine, a rotary breaking element drivably carried by the underframe, and reaction means on the underframe against which material may be impacted by the rotary breaking element, the reaction means being spaced laterally, with respect to the direction of travel of the auxiliary device, from an adjacent periphery of the rotary element so as to define between the rotary element and the reaction means a material breaking gap, whereby, in use, material on the conveyor entering the material breaking gap is broken against the reaction means by the rotary element as the latter rotates. In a preferred embodiment, the reaction means is in the form of a reaction plate.

Preferably, the rotary element is mounted with its axis of rotation upright. In another preferred arrangement, the rotary element is movably mounted on the underframe and means are provided for adjusting the spacing of the rotary element from the reaction plate, which means may include an overload device which is operative to adjust the spacing between the rotary element and the reacting plate to prevent the rotary device from being subjected to a predetermined overload.

Figure 2:
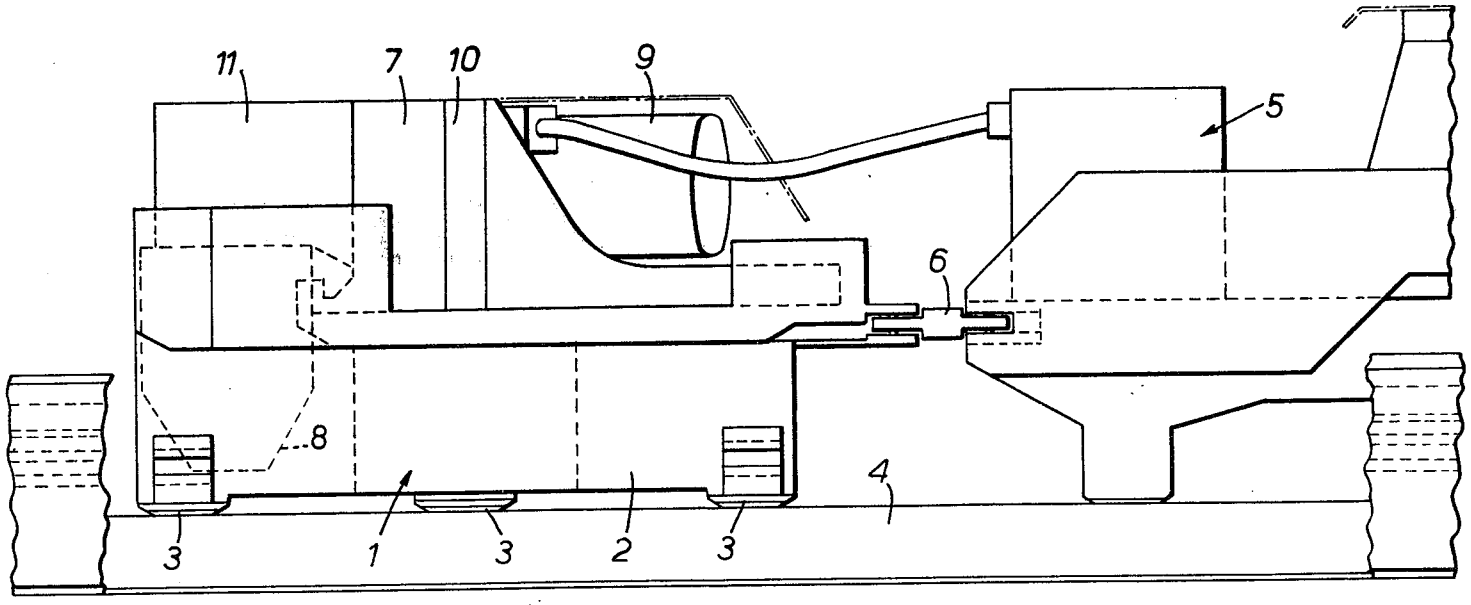
Figure 3:
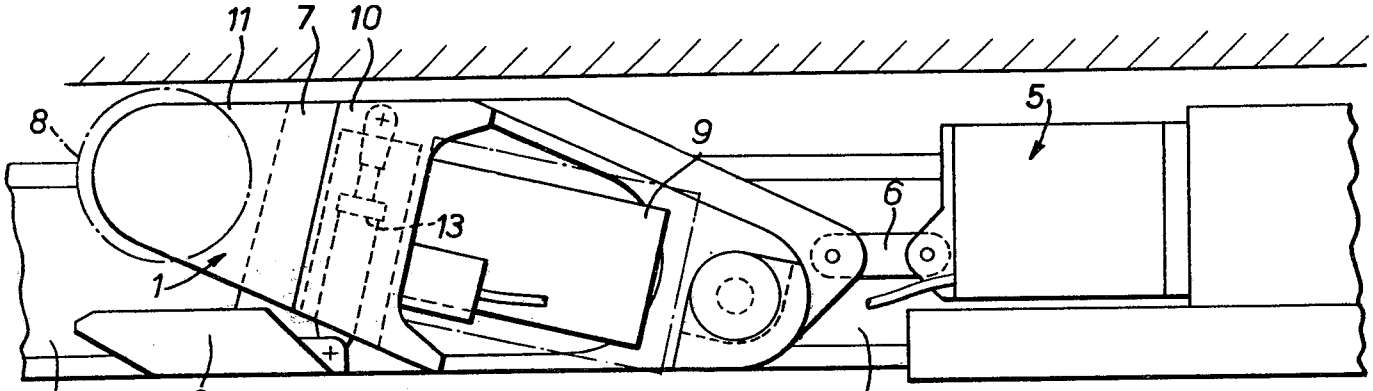
Figure 5:
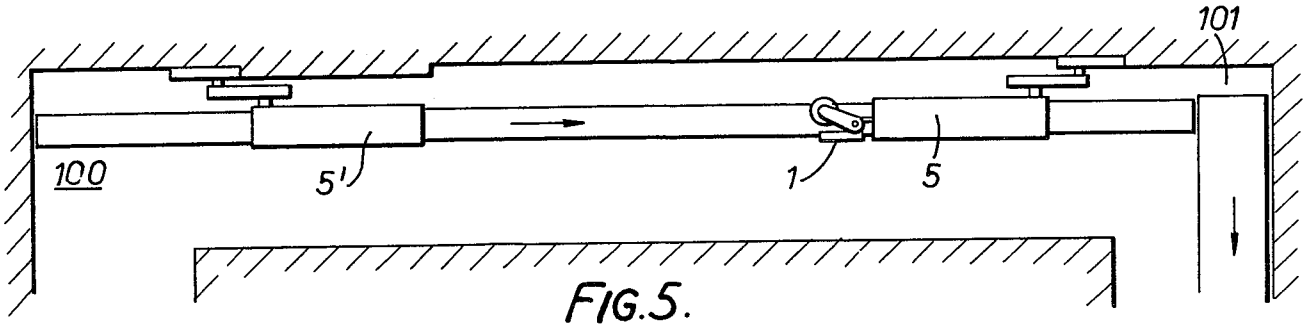

For a better understanding of the invention and to show how the same may be carried into effect, reference will now be made, by way of example, to the accompanying drawings, in which:

FIG. 1 is a general perspective view of one form of auxiliary device, in accordance with the invention, for a conveyor mounted, longwall mining machine, FIG. 2 is a side view of the auxiliary device, FIG. 3 is a plan view of the auxiliary device, FIG. 4 is a front elevational view of the auxiliary device, and FIG. 5 illustrates, diagrammatically, the use of two mining machines on the same conveyor, the main gate machine being provided with an auxiliary device in the form of a lump breaker.

FIG. 6 illustrates, highly diagrammatically, an adjusting, hydraulic, piston/cylinder arrangement for adjusting the width of the opening between the drum and reaction plate, with the hydraulic supply and overload relief depicted in highly simplified form.

Referring to FIGS. 1 to 4, the auxiliary device, shown at 1, comprises an underframe 2, provided with riding and trapping shoes 3 by which the auxiliary device is mounted on, and is guided along, an armoured face conveyor 4 of a conveyor mounted mining machine 5 which is shown in the Figures as a coal cutting machine (shearer) having a main underframe straddling the conveyor and to which the auxiliary unit is connected by a coupling bar 6.

The auxiliary device further comprises an arm assembly 7 which is pivotally attached at one end to the underframe 2 so that a rotary, coal breaking drum 8, which is carried by the other, free end of the arm assembly at its underside and which is driven by an electric motor 9, mounted on the arm assembly, by way of a fluid coupling 10 and a 90° gear box 11, can be displaced towards and away from a reaction plate 12 forming an integral part of the underframe 2 and being provided at the goaf side of the auxiliary device. The drum 8 carries picks 14, in order to break-up coal, and optionally, at its lower part, radial blades 15 which load coal onto the conveyor. The drum is driven in the direction of rotation indicated and the peripheral speed of the drum is greater than the conveyor speed in order that material from the coal face can be impacted against the reaction plate 12 by the rotating drum.

When constructed as a combined crusher/loader, the drum 8 needs to be adjustable in height with respect to the conveyor. This can be achieved by making the whole arm assembly 7 capable of being raised and lowered relatively to the underframe 2 or, alternatively, by arranging for the drum to be vertically displaceable with respect to the arm assembly. With the arm assembly swung outwardly in the face side direction and the drum in a lowered position, the blades 15 serve to load material onto the conveyor. To use the drum as a crusher, it is brought into a raised position and the arm assembly swung inwardly to position the drum over the conveyor.

FIG. 5 illustrates the use of two mining machines 5, 5′ on a single armoured face conveyor, the so-called "tail gate" drive of the conveyor being shown at 100 and the "main gate" drive (where coal arriving at the end of the conveyor is transferred to a 90° conveyor carrying the coal away from the coal face) being represented by reference numeral 101. During mining, lumps of coal, rock and other material, mostly removed from the coal face by the machine 5′ but some having fallen away from the coal face, are conveyed along the armoured face conveyor through the opening of the loading entrance between the rotary drum 8 and the reaction plate 12 of the auxiliary device 1 and from there to the main underframe of the mining machine 5 to pass beneath its underframe. It should be noted that the speed of the mining machine 5 as it moves along the conveyor is less than the conveyor speed so that the coal passes beneath the main underframe of the machine 5 in the direction of movement of the conveyor even when the mining machine 5 is being guided along the conveyor in the same direction of that of the conveyor movement. If it were not for the auxiliary device 1, large lumps of coal, stone and other material could become jammed underneath the main underframe of the mining machine 5. This problem is especially likely to arise where thick seam sections are being mined. However, the provision of the auxiliary device 1 prevents such jamming because these large lumps are impacted or crushed by the rotating drum 8 against the reaction plate 12 before the lumps arrive at the mining machine underframe. The width of the opening between the drum and reacton plate can be adjusted by pivoting the arm assembly 7 about its vertical pivot axis, an adjusting, hydraulic, piston/cylinder arrangement 13 (FIG. 3) being provided for this purpose. The hydraulic cylinder can also incorporate a relief valve R (FIG. 6) which relieves excess hydraulic pressure in the cylinder when a pre-set threshold value, corresponding to an overload of the auxiliary device, is exceeded. Such pressure relief increases the size of the opening between the drum and reaction plate to prevent damage to the auxiliary device in the event of an overload, such as occurs when any unbreakable materials (e.g. tramp metal) enters between the drum and reaction plate.

We claim:

1. An auxiliary device adapted to be connected to a conveyor mounted, longwall mining machine, the auxiliary device comprising an underframe adapted for mounting on and travel along the conveyor of the mining machine, a rotary breaking element drivably carried by the underframe, and reaction means on the underframe against which material may be impacted by said rotary beaking element, the reaction means being spaced laterally, with respect to the direction of travel of the auxiliary device, from an adjacent periphery of the rotary element so as to define between the rotary element and the reaction means a material breaking gap, whereby, in use, material on the conveyor entering the material breaking gap is broken against the reaction means by the rotary element as the latter rotates.

2. An auxiliary device according to claim 1, wherein the reaction means is in the form of a reaction plate.

3. An auxiliary device according to claim 1, further comprising an electric motor and a fluid coupling connecting the electric motor to the rotary element via a gearbox.

4. An auxiliary device according to claim 1, wherein the rotary element is mounted with its axis of rotation substantially vertical.

5. An auxiliary device according to claim 4 and intended to be used as a breaker/loader, wherein the rotary element includes blades constructed to load material onto the conveyor, in use, and breaking picks.

6. An auxiliary device according to claim 4, wherein the rotary element is movably mounted on the underframe and means are provided for adjusting the spacing of the rotary element from the reaction plate.

7. An auxiliary device according to claim 6, wherein the rotary element is mounted on an arm assembly pivotally attached at one end to the underframe.

8. An auxiliary device according to claim 6, wherein the adjusting means includes an overload device which is operative to adjust the spacing between the rotary element and the reaction plate to prevent the rotary element from being subjected to an overload.

9. An auxiliary device according to claim 8, wherein the adjusting means comprises a hydraulic piston and cylinder arrangement.

10. An auxiliary device according to claim 9, wherein the hydraulic cylinder is provided with a relief valve which is arranged to open to release hydraulic pressure in the hydraulic piston and cylinder arrangement when the rotary element is subjected to a predetermined overload.

* * * * *